United States Patent [19]

LeBlanc

[11] Patent Number: 4,638,715

[45] Date of Patent: Jan. 27, 1987

[54] HANDWHEEL ASSEMBLY FOR WEAPON SYSTEM

[75] Inventor: Richard S. LeBlanc, Mt. Clemens, Mich.

[73] Assignee: General Motors Corporation, Detroit, Mich.

[21] Appl. No.: 761,916

[22] Filed: Aug. 2, 1985

Related U.S. Application Data

[60] Division of Ser. No. 680,799, Dec. 13, 1984, Pat. No. 4,574,683, which is a continuation of Ser. No. 437,853, Oct. 29, 1982, abandoned.

[51] Int. Cl.[4] ..... F41F 21/08

[52] U.S. Cl. ..... 89/41.12; 89/28.2; 200/153 T

[58] Field of Search ..... 89/27.3, 28.2, 41.12, 89/135, 136; 200/153 T, 332

[56] References Cited

U.S. PATENT DOCUMENTS

| | | | |
|---|---|---|---|
| 2,368,191 | 1/1945 | Berg | 89/27.3 |
| 2,442,164 | 5/1948 | Ferris | 89/136 |
| 4,138,603 | 2/1979 | Hudimac | 200/153 T |

*Primary Examiner*—Stephen C. Bentley

*Attorney, Agent, or Firm*—Edward J. Biskup

[57] ABSTRACT

A handwheel assembly for a weapon system including a main gun using link fed ammunition and a co-axially mounted machine gun mounted in a turret rotatably positionable in a armored vehicle. The linked ammunition for the main gun is stored in a rectangular shaped ammunition box positioned diametrically in the turret basket. The handwheel assembly is characterized in that it has manual trigger and main gun elevation assembly that includes a mechanical connection between the trigger and the trigger switch which does not rotate with the trigger and handwheel. The link eject chutes for the main gun, which can be a dual fed 25 millimeter gun, include guide strips for guiding the tab members of the links through the chute channels and thereby preventing jamming.

2 Claims, 17 Drawing Figures

HANDWHEEL ASSEMBLY FOR WEAPON SYSTEM

This is a division of application Ser. No. 680,799 filed on Dec. 13, 1984, now U.S. Pat. No. 4,574,683 which is a continuation of application Ser. No. 437,853 filed on Oct. 29, 1982, now abandoned.

FIELD OF THE INVENTION

The present invention relates to a weapon system for an armored vehicle turret. The invention further relates to ammunition storage boxes, feeding means and spent link ejecting chutes for the ammunition for such a system, as well as handle elevation and trigger assemblies for the main gun. More particularly, it relates to a weapon station mounted on a two man turret which includes an M242 25 millimeter cannon and an M240 7.62 Coax machine gun.

BACKGROUND OF THE INVENTION

In the prior art, there have been developed and used various types of armored vehicles having rotatable turrets with guns mounted thereon. Problems have developed though in that the ammunition has not been stored in such a manner that it could freely feed to the main gun without getting bunched and jammed. Further, after the guns had been fired and the brass ejected, no suitable means had been developed for moving the spent links in a free flowing manner away from the gun to a discharge means. This is particularly important since when the ejected links jam the gun quits firing. In the past, it was also the common practice to collect the spent links within the armored vehicle despite the fact that they occupy valuable vehicle space.

It was also the practice to have the main storage box for the link fed ammunition for the main gun be configured in an arcuate shape along part of the circumference of the basket platform. The linked ammunition would be stored in this box in a layered manner. However, these stored links would then have a fan like configuration, which would tend to become intermeshed and entangled particularly as the vehicle traversed rough terrain. When tangled the linked ammunition could not be fed continuously to the gun and the gun would stop firing until the ammunition was straightened out.

A serious previously-unsolved problem was caused by the link eject means. The links have guide tabs, as more fully described later, which travel in channels in the arcuate shaped link eject chutes. The sharp edges of the guide tabs would cut into the channels as the links traveled around the curved portions thereby jamming the links in the eject chutes and shutting the gun down.

In the past the manual elevation and trigger assembly for the weapon system included a handwheel rotatable by a handle positioned to the left of the gunner. The rotating handwheel activated through a gear box the pump for the fluid actuated cylinder drive means which then elevated the gun. The trigger button was activated by the gunner's left thumb and had a direct electrical contact through rotating electrical brushes in the rotating handwheel to the firing mechanism. The brushes would tend to wear, necessitating in-field replacement. This was a complicated and expensive arrangement.

In the past, it should also be noted that no light armored turret had been developed to successfully carry an M242 weapon station, consisting of an M242 25 millimeter automatic cannon and an M240 7.62 Coax machine gun. The present invention is the first such light armored turret with such a weapon station.

OBJECTS OF THE INVENTION

Accordingly, it is the principal object of the present invention to provide an improved weapon system for a rotatable turret.

Another object of the present invention is to provide a two man turret containing a weapons station which includes an M242 25 millimeter automatic cannon and an M240 7.62 millimeter Coax machine gun.

A further object of the present invention is to provide a novel storage box for link fed ammunition.

A still further object of the present invention is to provide an improved arrangement of the operator's and gunner's stations within a two man turret.

Another object of the present invention is to provide an improved design for feeding linked ammunition to the gun which allows the ammunition to flow freely and continuously without getting jammed in the storage box especially when the vehicle is traversing rough terrain.

A further object of the present invention is to provide an improved system for ejecting the spent ejection links in a continuous manner.

A still further object of the present invention is to provide an improved link ejection chute which allows the ejection links to flow freely out of the gun without being jammed.

Another object of the present invention is to provide an improved method of disposing of the ejected links, brass, and propellant gases.

A further object of the present invention is to provide a novel means for ejecting the links outside of the vehicle which is provided with suitable protection for the link eject outlet so that enemy fire does not enter through that outlet.

A still further object of the present invention is to provide an improved gunner's station with the manual firing control button positioned conveniently at the right side thereof.

Another object of the present invention is to provide an improved manual elevation and trigger assembly.

Other objects and advantages of the present invention will become more apparent to those persons having ordinary skill in the art from the following description taken in conjunction with the accompanying drawings.

THE DRAWINGS

DESCRIPTION OF THE PREFERRED EMBODIMENT

Figure 1:
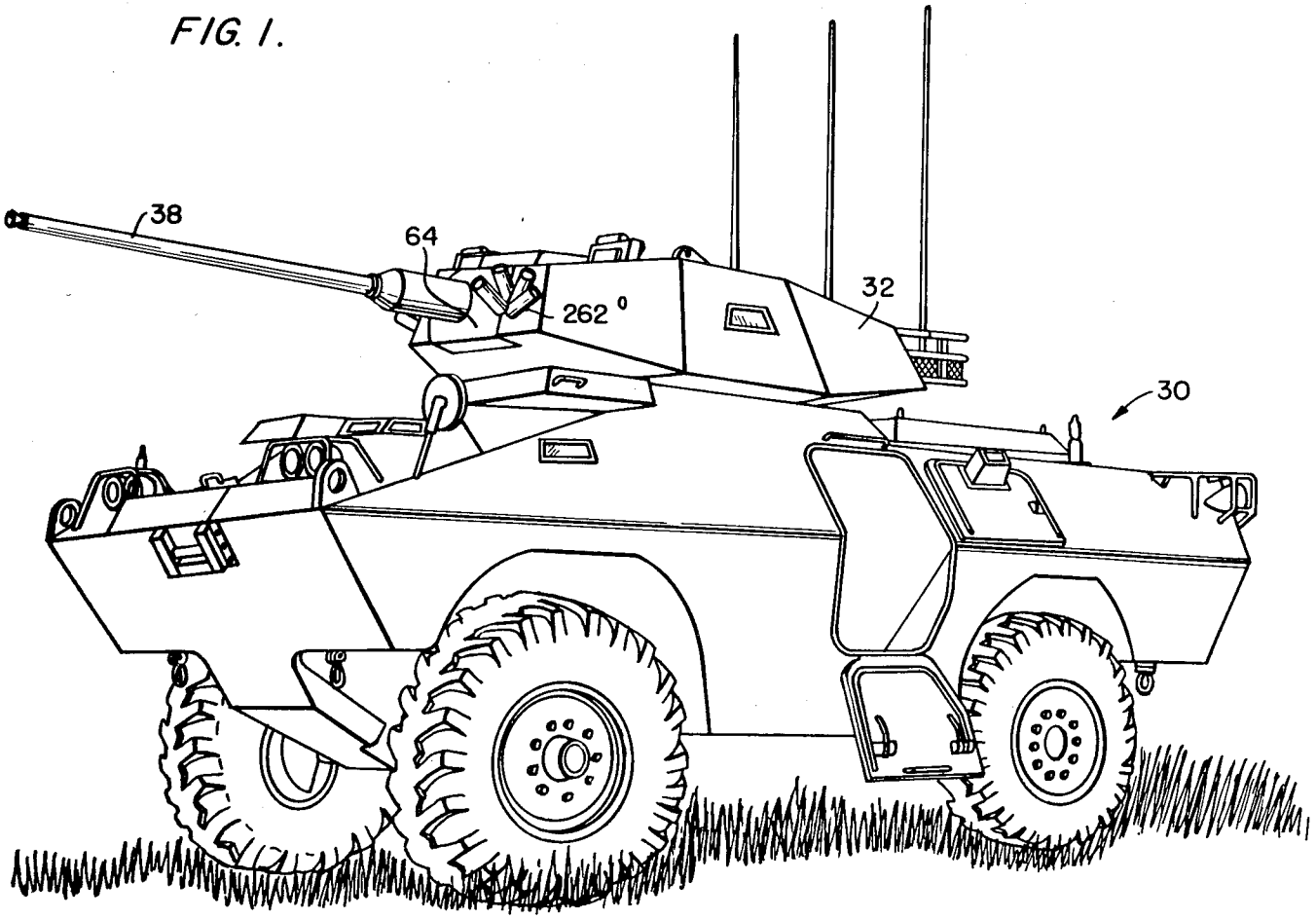
FIG. 1 is a perspective view of the present invention shown mounted in an armored vehicle.

Referring to the drawings, there is illustrated an embodiment of the present invention. Generally, this embodiment includes an armored vehicle 30, as shown in FIG. 1 (other types of carriers may be used though including the General Motors 8×8), a turret shown generally at 32 supported on a large diameter bearing mounted on a roof portion of vehicle 30, a basket assembly shown generally at 34 (FIG. 2) secured to, by bolts or similar means, and depending from the turret 32, and a rotor mounting assembly shown generally at 36 (FIG. 7) mounted to the turret. A main gun 38 and a machine gun 40 are attached to the rotor mounting assembly 36. Feed chutes shown at 42 feed ammunition from the ammunition storage box 44 to the main gun 38. The ammunition storage box 44 is positioned on the floor 45 (FIGS. 2, 3, 4) of the basket assembly 34. Link ejection chutes shown generally at 46 (FIGS. 3, 5) guide the ejected ammunition links from main gun 38 through rotor mounting assembly 36 into compartment 48, which opens to the exterior of the vehicle 30. The linked ammunition for machine gun 40 is fed by machine gun feed chutes 50 from machine gun ammunition storage box 52 positioned in turret 32 to the machine gun 40. The present turret and basket assembly is a two man turret and a commander's station shown generally at 54 is positioned on the right side of ammunition storage box 44 and the gunner's station shown generally 56 is positioned on the left side. And the elevation handwheel and auxiliary trigger assembly shown generally at 58 (FIG. 4) is positioned on the right side of the gunner station 56.

Figure 5:
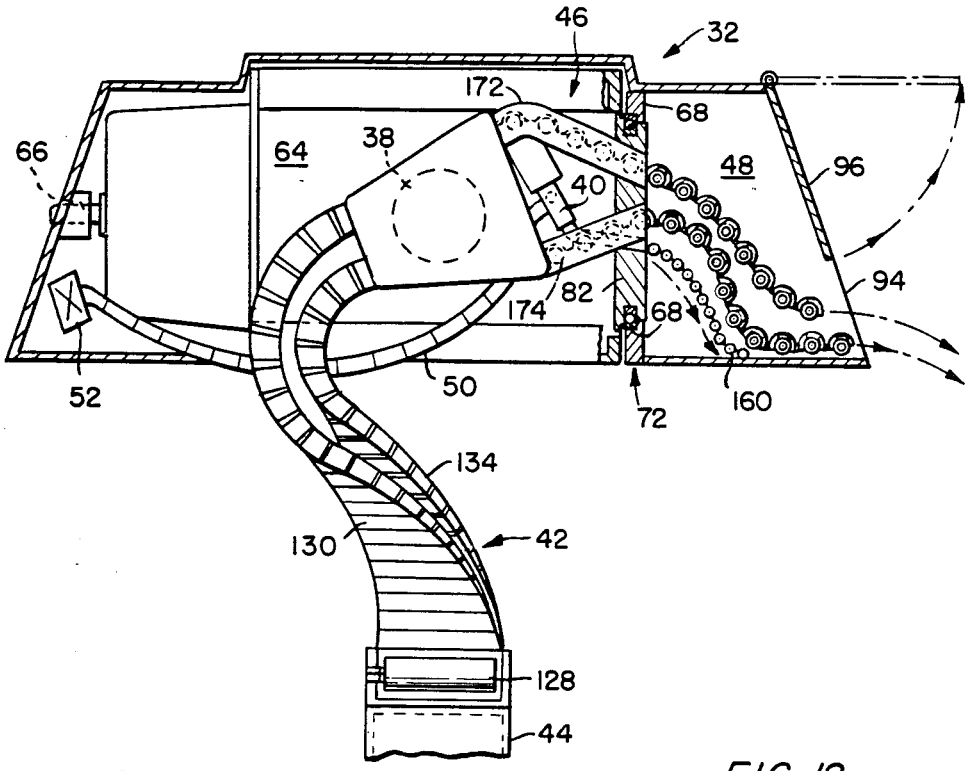
FIG. 5 is a rear elevational view thereof illustrating the ammunition eject assembly.
Figure 7:
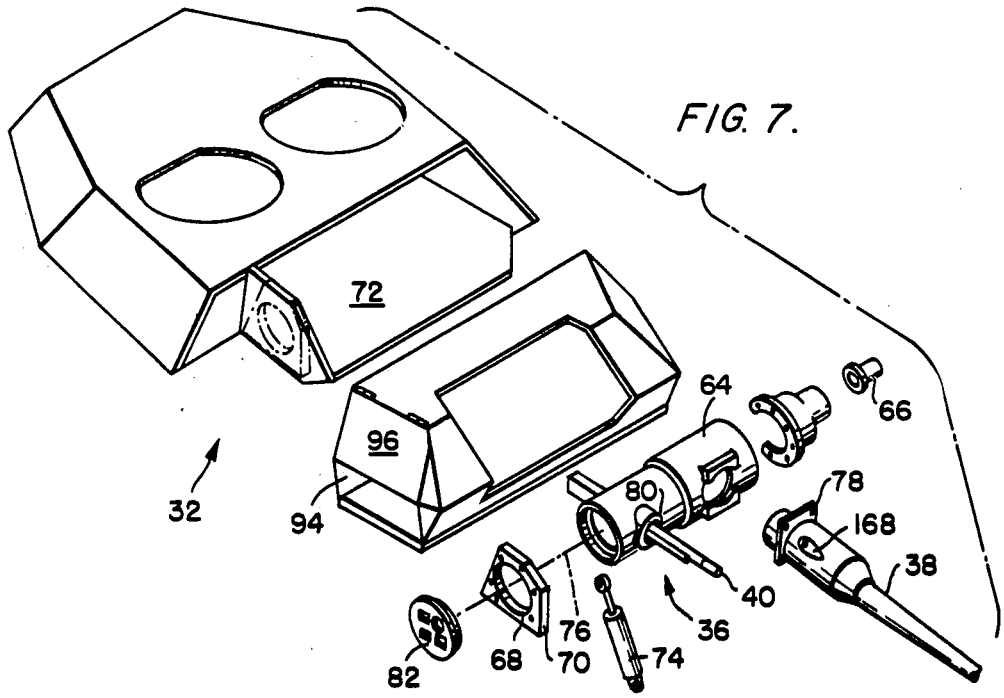
FIG. 7 is a perspective view of the turret of FIG. 1 illustrating the gun mounting means in an exploded view.

Referring to FIG. 7, rotor mounting assembly 36 is best illustrated. Assembly 36 includes a main rotor 64 journaled in the side of turret 32 on one side by spindle bearing 66 and in a large-diameter trunnion bearing 68 in bearing retainer support 70. Thus, as hydraulic cylinder means 74, which is pivotally attached at opposite ends to the rotor mounting assembly and to the turret 32 extends and retracts, rotor 64 is caused to rotate as seen in FIGS. 5 and 7, in spindle bearing 66 and trunnion bearing 68 about horizontal axis 76. It should be noted that as seen in FIG. 5 the use of spindle bearing 66 provides more room for ammunition feed chutes 42 than would a trunnion bearing, for example. The main gun 38 in the preferred embodiment is an M242 25 millimeter cannon which is secured to the mantlet of rotor 64 by connection plate 78. Machine gun 40 is co-axially mounted with the main gun 38 through cylindrical opening 80 in the mantlet of the rotor 64.

Figure 8:
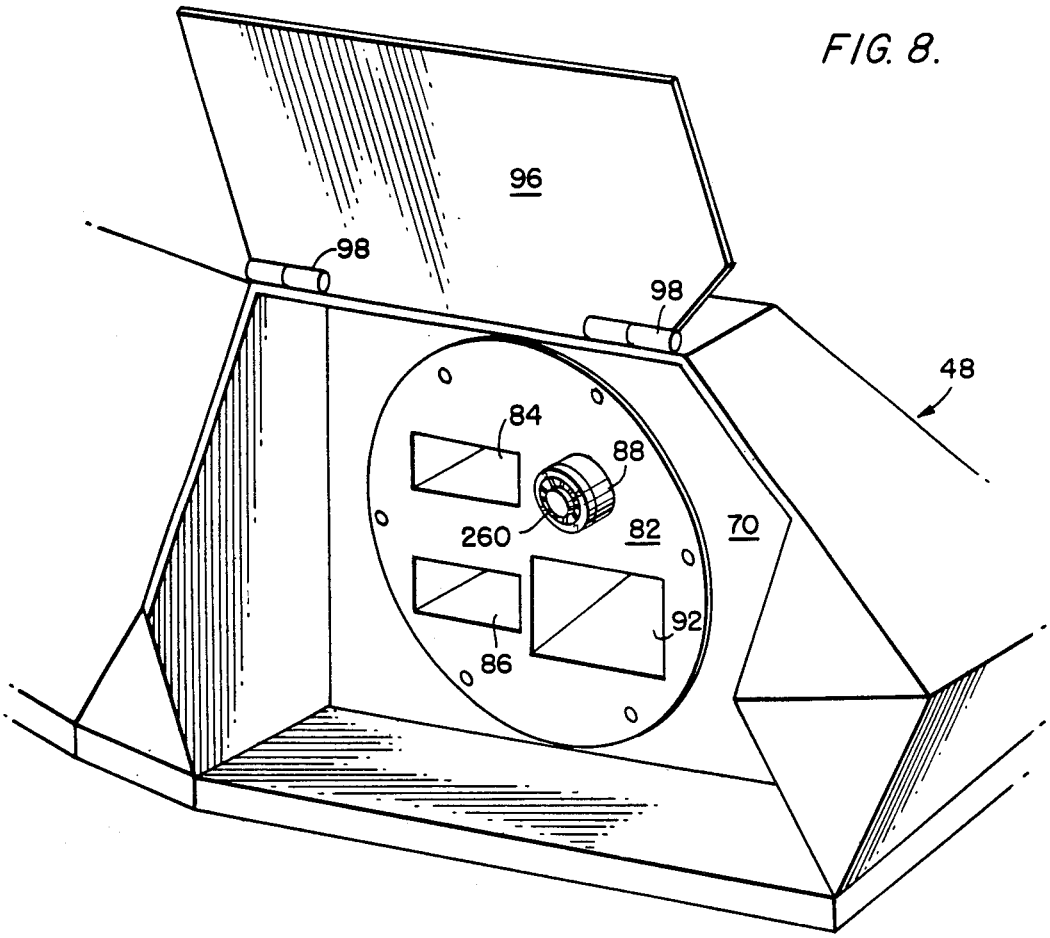
FIG. 8 is an enlarged perspective view of the rotor end cap and link eject compartment of FIG. 7.

Referring to FIG. 8, it is seen that rotor end cap 82 which is attached to the end of main rotor 64 and rotatable therewith has four openings 84, 86, 88 and 92. The upper opening 84 is the ejection link opening for the armor piercing ammunition links, the lower opening 86 is for the high explosive links, the upper right opening 88 is the opening for propellant gases by the exhaust blower and the large lower right opening 92 is the opening for the ejected links and brass for machine gun 40. As best shown in FIG. 8, the links, brass and propellant gases are ejected from the four openings 84, 86, 88 and 92 into compartment 48. This compartment, as shown in FIG. 7, opens to the exterior of the vehicle 30. Along the lower outer portion of the compartment is a slot 94 out of which the discharged links pass through. In one embodiment of the invention and as best shown in FIG. 8, a door 96 attached to the turret 32 by hinges 98 is forced open when spent links and brass accumulate in compartment 48. Suitable springs (not shown) can be provided to hold door 96 shut. The compartment 48 and door 96, if used, are configured to best deflect enemy fire as well as to prevent enemy fire from entering through the openings 84, 86, 88 and 92 in the rotor end cap 82.

Figure 2:
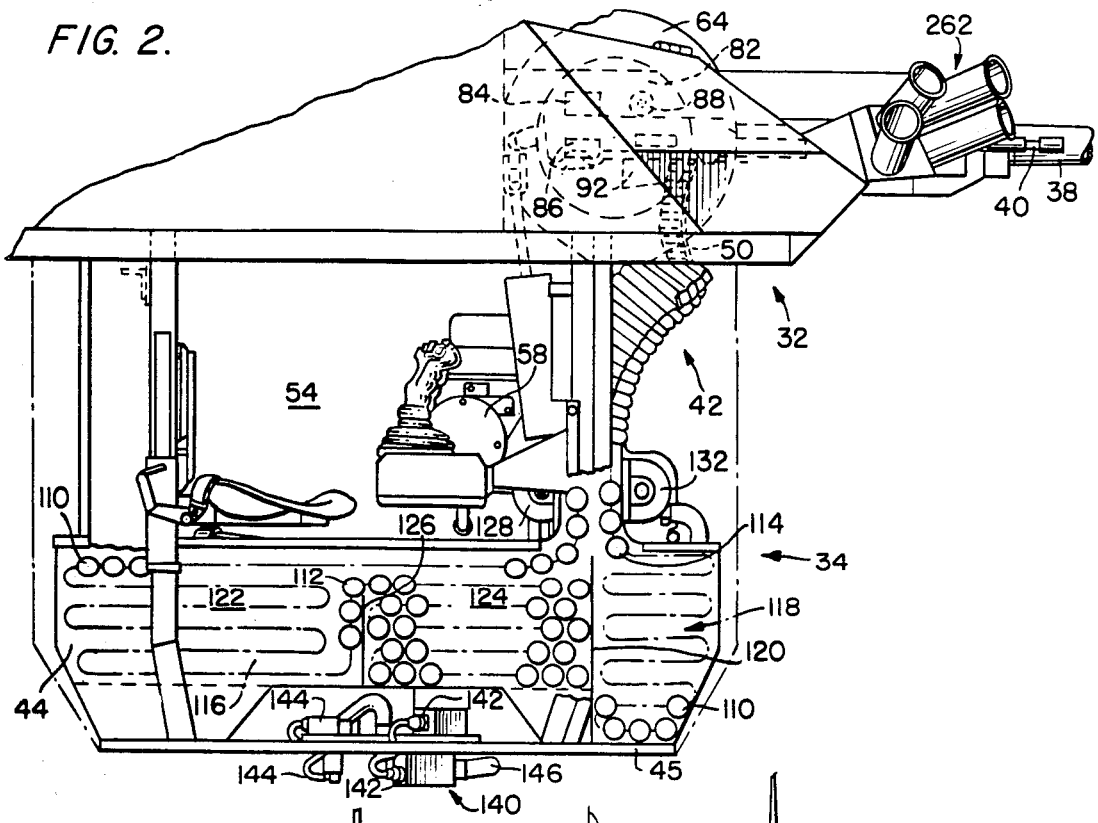
FIG. 2 is a right side view of the turret and depending basket assembly of FIG. 1 having portions thereof partially broken away.
Figure 3:
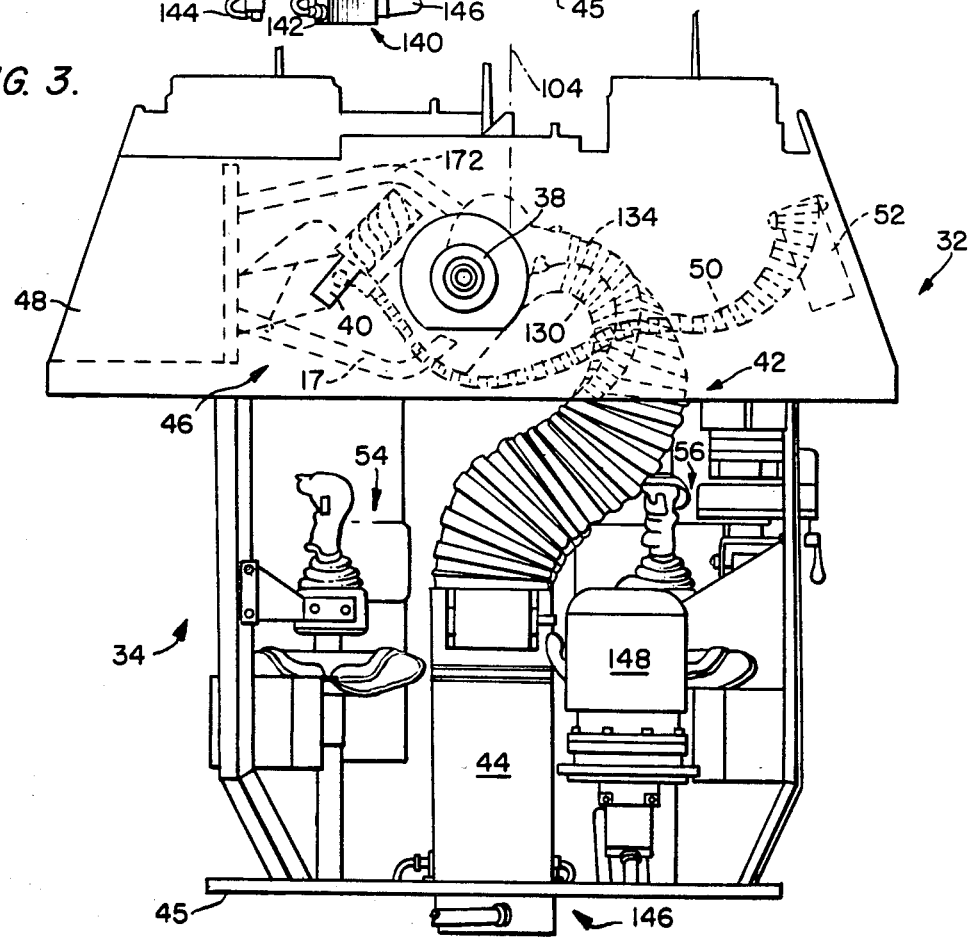
FIG. 3 is a front elevational view of the turret and basket assembly of FIG. 2.
Figure 4:
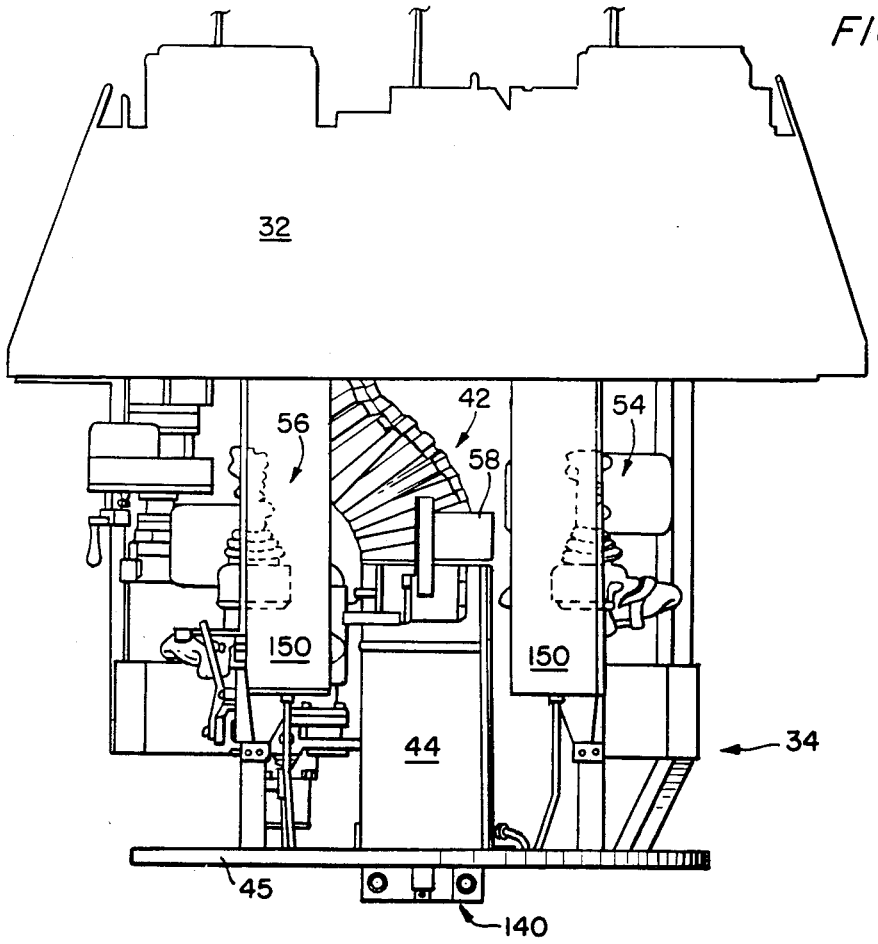
FIG. 4 is a rear elevational view of the turret and basket assembly of FIG. 2.
Figure 12:
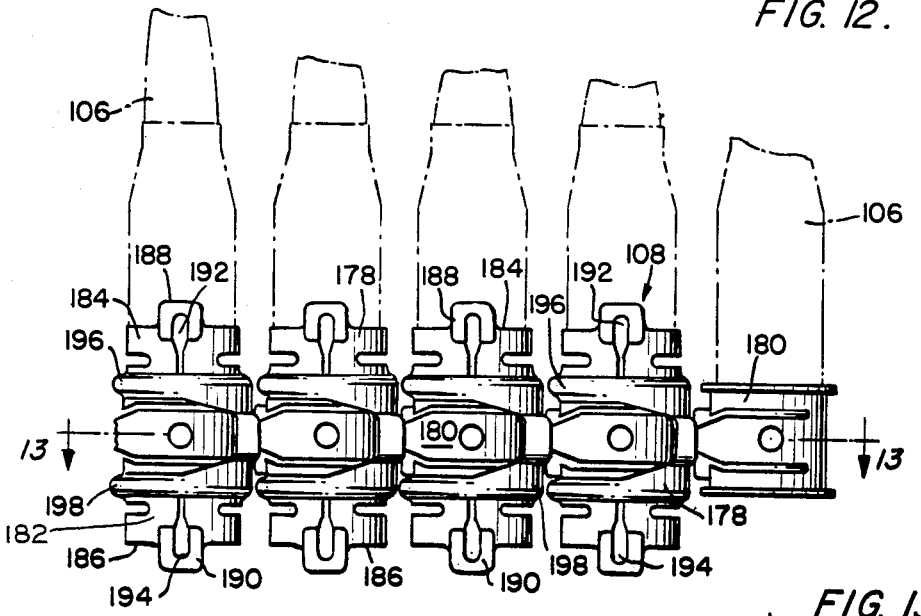
FIG. 12 is an elevational view of the eject links in linked form with the ammunition rounds and brass illustrated in phantom lines.
Figure 13:
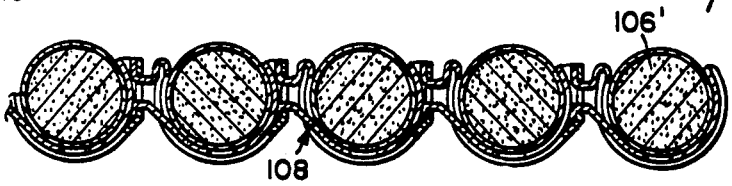
FIG. 13 is a cross sectional view taken along line 13—13 of FIG. 12.

As seen in FIG. 3 ammunition storage box 44 is mounted diametrically on floor 45 and is generally aligned with main gun 38. However, as shown in FIG. 3, main gun 38 is mounted slightly off center, the center line being shown at 104, and towards compartment 48. This allows for shorter link ejection chutes 46, thereby minimizing link ejection jamming in these chutes, as does the inclusion of previously-discussed compartment 48. Referring to FIGS. 12 and 13, the linked 25 millimeter ammunition is best illustrated. The rounds and brass, shown in phantom lines at 106, are carried in links 108, which become disconnected after firing and when deposited in the compartment. Prior to firing, the links 108 with the 25 millimeter rounds held therein are stored in the ammunition box 44 in a layered manner as shown in FIG. 2 by dotted lines and circles 110. Small ramps (not shown) can be positioned in the bottom of ammunition box 44 and hold the ends of rounds 106 up so that the links 108 are maintained in a level fashion.

Figure 14:
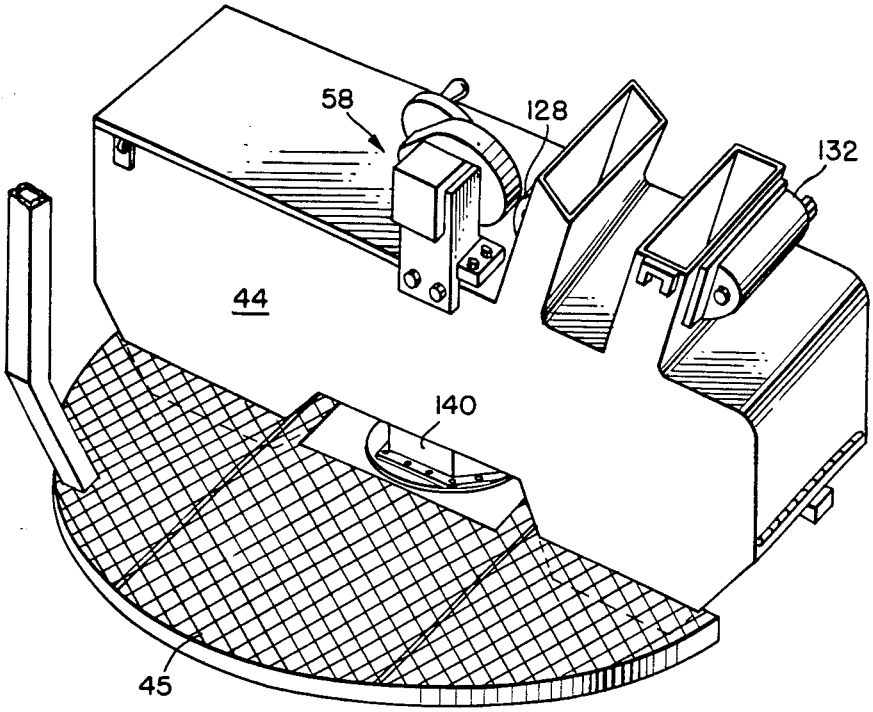
FIG. 14 is a perspective view illustrating the ammunition box of FIG. 2.

Main gun 38 is a dual fed gun capable of handling either high explosive ammunition shown in FIG. 2 at 112 or armor piercing ammunition shown in FIG. 2 at 114. A selection means (not shown) connected to the gun is positioned in both the commander's station 54 and the gunner stations 56 for selecting the desired ammunition. Ammmunition storage box 44, as best shown in FIG. 2, is separated into two compartments shown generally at 116 for the rear portion and the forward compartment portion at 118. Armor piercing ammunition 114 is stored in forward compartment portion 118 and high explosive ammunition 112 is stored in the rear compartment portion 116. The two compartments 116 and 118 are separated by wall 120. Rear compartment 116 is further divided into two areas 122 and 124 which are separated by baffle 126. As illustrated in FIG. 2, the explosive ammunition 112 is fed from the rear area 122 first and when that area has been emptied then the ammunition feeds from front area 124. A conventional high explosive round manual forwarder 128 feeds the ammunition from the storage box 44 up through high explosive ammunition flexible chute 130 to main gun 38. The high explosive round forwarder 128 is mounted on ammunition storage box 44. A similar conventional forwarder for the armor piercing ammunition shown at 132 is also mounted on ammunition storage box 44, as shown in FIG. 14. Forwarder 132 initially feeds the armor piercing rounds up through armor piercing flexible chute 134 to the main gun. As the gun 38 fires, the main links 108 are automatically pulled up. Each of the forwarders has the usual forwarder sprockets (not shown) which engage the ammunition rounds and turn freely while the gun is firing.

Figure 6:
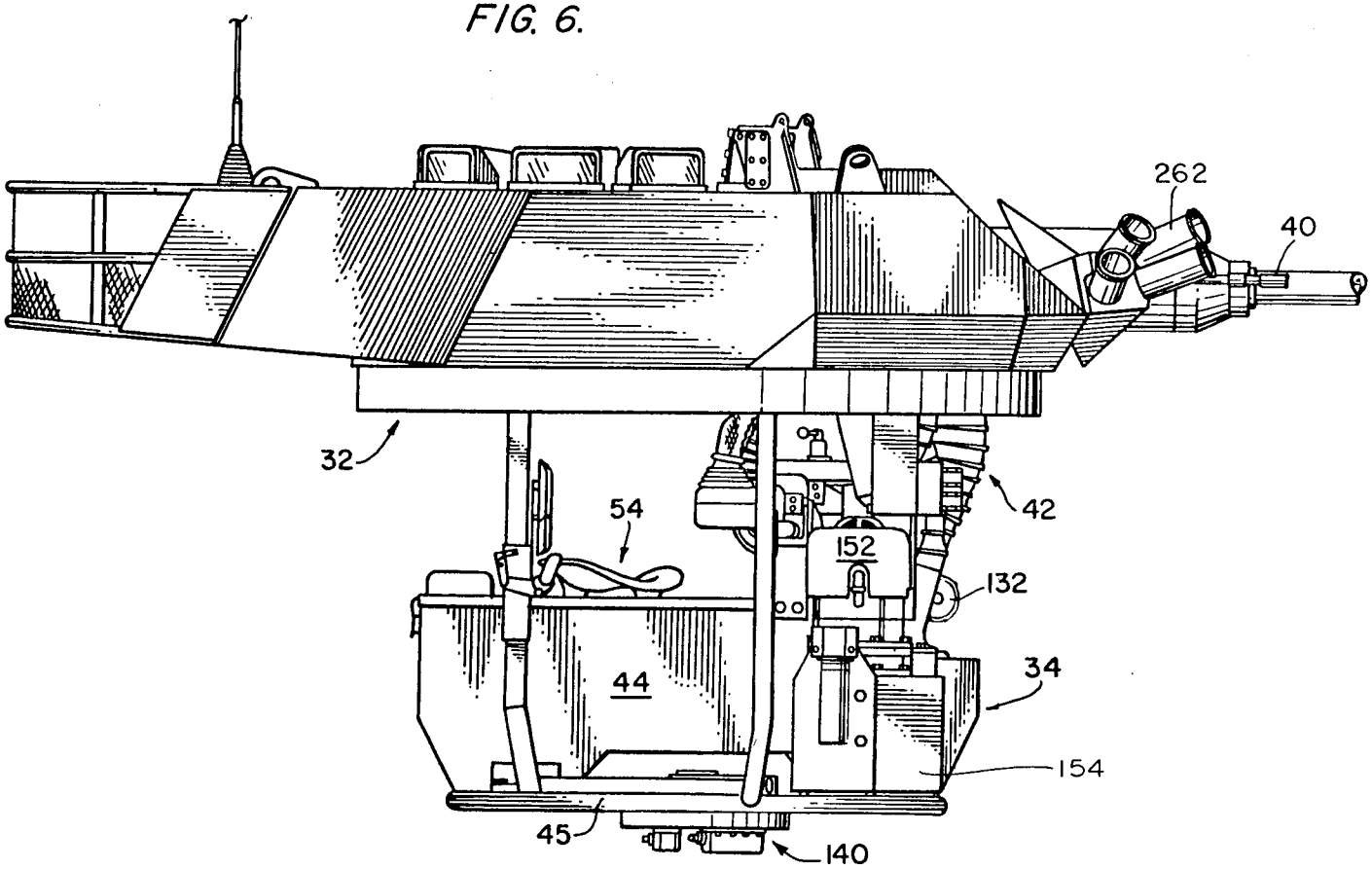
FIG. 6 is a view similar to FIG. 2 illustrating a second embodiment of the present invention.

Ammunition storage box 44, as previously mentioned, is diametrically disposed on the floor 45 of the basket assembly 34 and as shown in FIG. 2 is positioned over slip ring assembly shown generally at 140. Slip ring assembly 140 comprises a novel flattened pancake-like shape and provides the connection between the vehicle 30 and the basket assembly 34 for the electrical, hydraulic and pneumatic power lines. More particularly, the power connections are shown at 142, the communication connections at 144 and the NBC connection at 146. The electric motor and pump assembly 148 is positioned as seen in FIG. 3 at a forward location of basket assembly 34 on basket floor 45 adjacent ammunition box 44. However, another embodiment of the present invention, as best illustrated in FIG. 6, includes the electric motor and pump assembly 152 mounted on top of the reservoir 154 and positioned at the front of basket assembly 34.

As seen in FIG. 12, the machine gun ammunition links 160 are fed out of the compartments in machine gun ammunition storage box 52 initially by the forwarder sprockets through feed chute 50 to machine gun 40. In the preferred embodiment machine gun ammunition box 52 is mounted in turret 32, as illustrated in FIG. 3, generally to the right of the main gun 38. The machine gun feed chute 50 then travels a path beneath the main gun 38 to the machine gun 40. Another emmbodiment (not shown) of the present invention positions the machine gun storage box generally below the machine gun.

Figure 9:
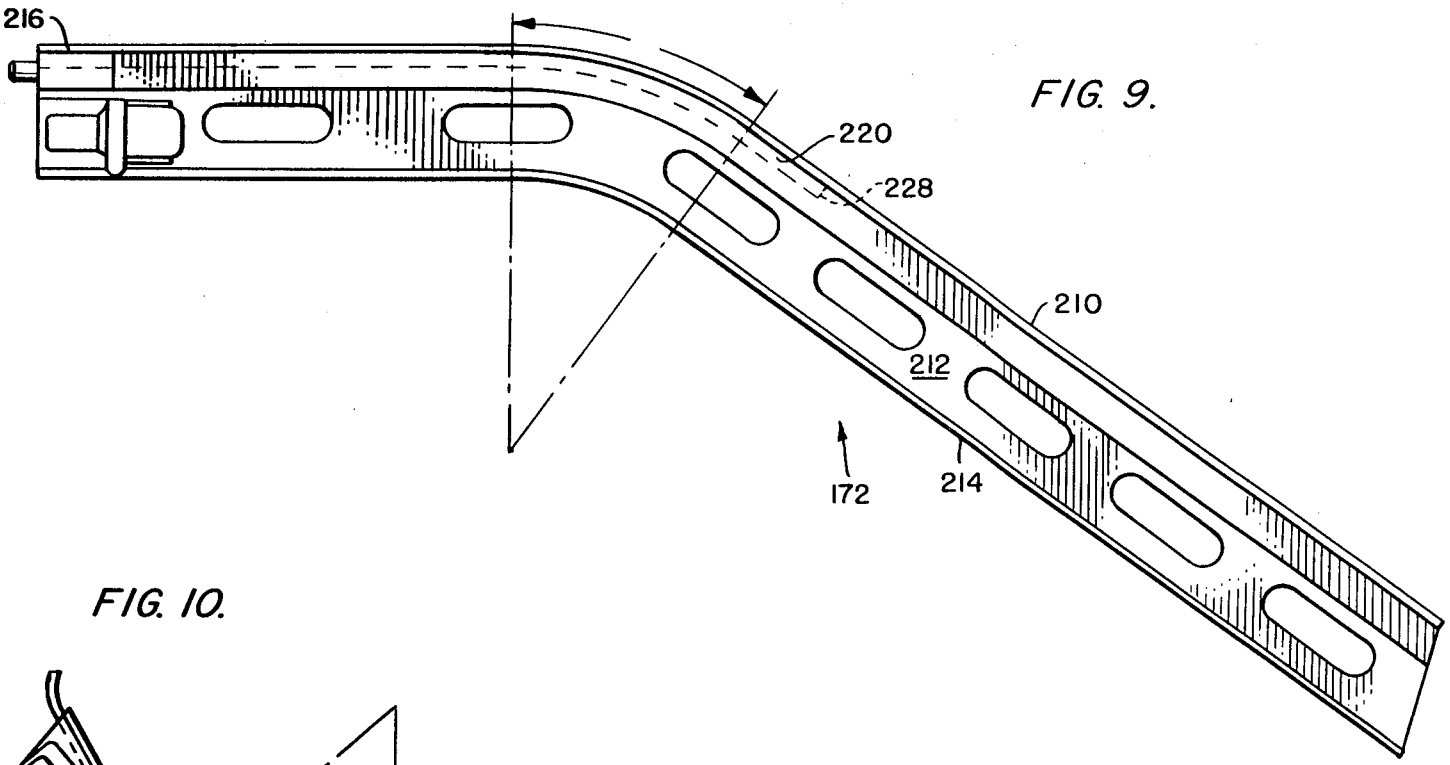
FIG. 9 is a side elevational view of the upper ammunition discharge chute of FIG. 3 and illustrated in isolation.
Figure 10:
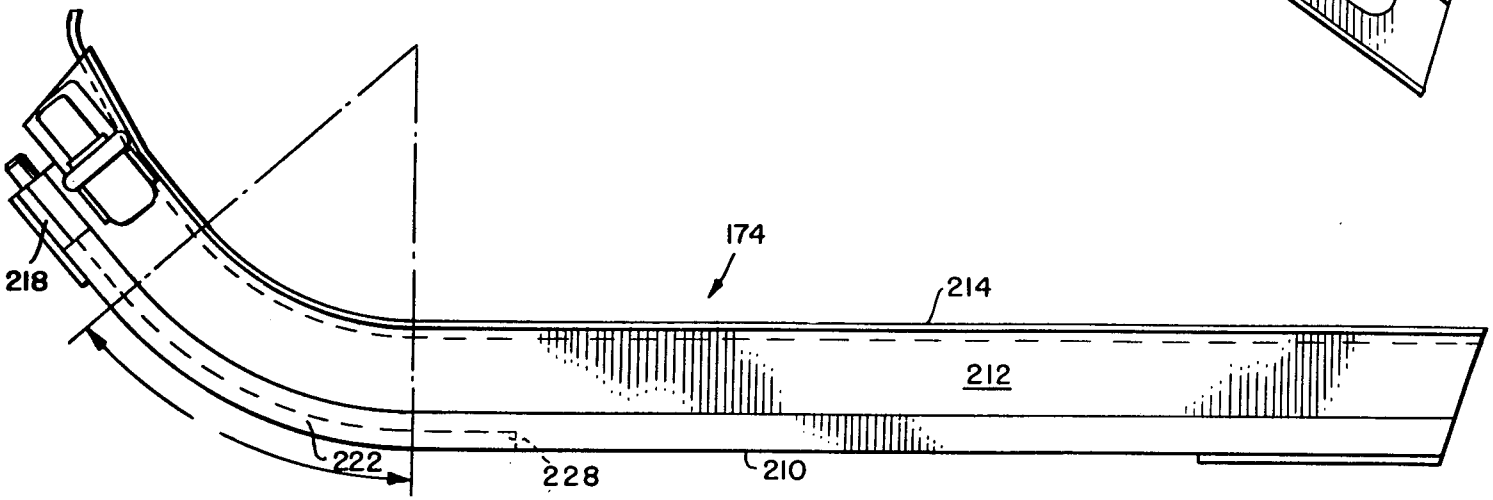
FIG. 10 is a side elevational view of the lower ammunition discharge chute of FIG. 3 illustrated in isolation.
Figure 11:
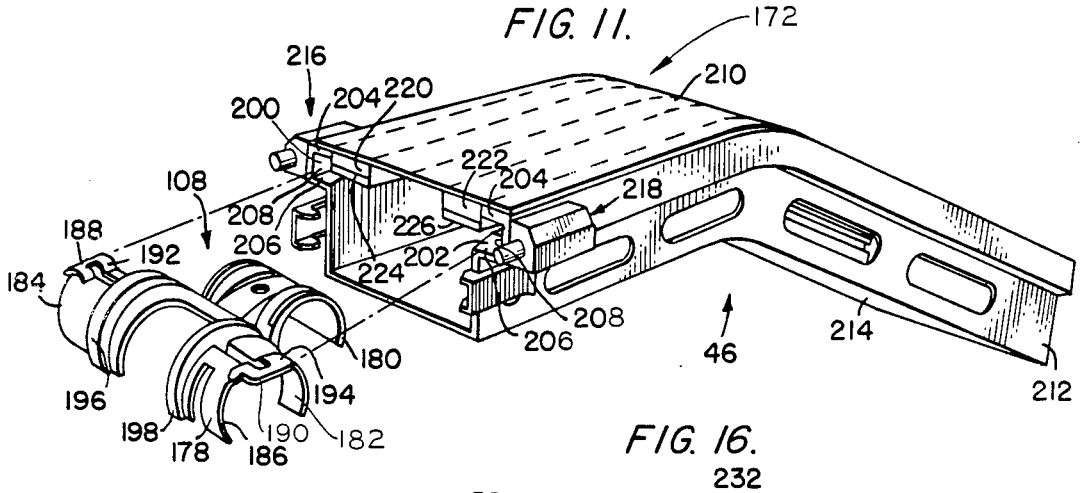
FIG. 11 is a perspective view of the discharge chute of FIG. 9 illustrating the travel path of the ejected links.

As previously mentioned, link ejection chutes 46 eject the still-connected links 108 from the main gun 38 to compartment 48. The brass having been ejected forward out of brass opening 168, best shown in FIG. 7, in the main gun 38. Two ejection chutes are provided for the present dual feed gun 38—an upper armor piercing link discharge chute 172 as shown in isolation in FIGS. 9 and 11, and a lower high explosive link discharge chute as shown in isolation at 174 in FIG. 10. As previously mentioned and especially with the M242 25 millimeter gun, the link chutes have proven to be the Achilles heel for the entire weapon system. This is because the links 108 tended to jam in the chutes thereby shutting the gun down. Referring to FIGS. 11, 12, and 13 is is seen that each link 108 has a cylindrical portion 178 and a smaller cylindrical connection portion 180 attached thereto. The cylindrical portion 178 has a cylindrical surface 182 and ends 184 and 186. Guide tabs 188 and 190 are attached to ends 184 and 186 respectively. Not only do these tabs protrude from the ends but they also have raised portions 192 and 194 respectively raised from cylindrical surface 182 and generally adjacent ends 184 and 186 respectively. Ribs 196 and 198 also protrude from cylindrical surface 182. Guide tabs 188 and 190 are provided to ride in channels 200 and 202 of the guide chute, as best shown in FIG. 11. These channels 200 and 202 are generally U-shaped and have outer surfaces 204, inner surfaces 206 and end surfaces 208. The guide tabs have rough or cutting edges which heretofore have tended to dig into channels 200 and 202 when the links 108 round a bend in the link chutes, thereby jamming the links 108 in the chutes. Ideally, the tabs would not become jammed in the channels 202 if the link chutes were straight but due to the design configurations of this turret mounted weapon systems it is necessary that the chutes 46 be curved. The chutes 46 also have upper skins 210, side panels 212, and lower skins 214. These upper and lower skins 210 and 214 and side panels 212 define a generally rectangular passageway for the links 108, as shown in FIG. 11. Attachment clips 216 and 218 are mounted to the sides of channels 200 and 202 respectively and are attached to corresponding female members on the main gun 38.

The present invention provides for guide strips 220 and 222 secured adjacent outer surface 204 and to the inner surface of the upper skin 210. These guide strips 220 and 222 have a width greater than the adjacent outer surfaces 204 whereby the inner surfaces, as shown at 224 and 226, of guide strips 220 and 222 extend further toward the center of the associated chute than do outer surfaces 204. Inner guide strip surfaces 224 and 226 engage raised portions 192 and 194, respectively, of the tabs 188 and 190 and thereby prevent the edges of the tabs 188 and 190 from engaging and jamming into upper channel surface 204. The links 108 may then flow freely through the chutes 172 and 174 into the compartment 48. The guide strips 224 and 226 need not extend the entire length of the chutes but can end once the links 108 have rounded the arc portion as shown at 228 in FIGS. 9 and 10. Using the same general principal for guiding the links 108 in the chutes 172 and 174, the guide strips 224 and 226 could alternatively be configured and positioned so that they engage the rib portions 196 and 198.

Figure 16:
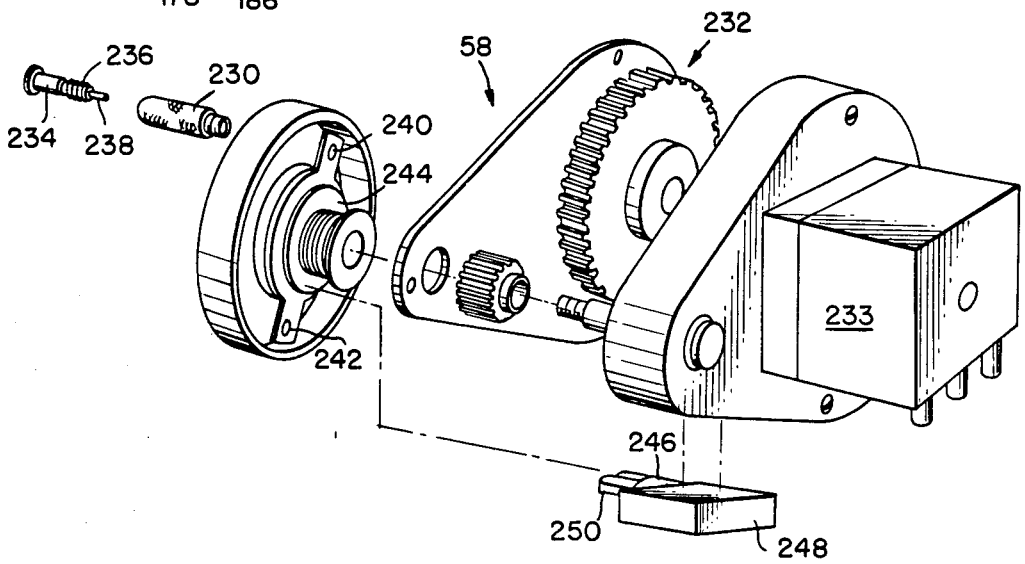
FIG. 16 is a perspective view of the elevation handwheel and trigger assembly and gear box assembly of FIG. 2 illustrating the parts in exploded relation.
Figure 17:
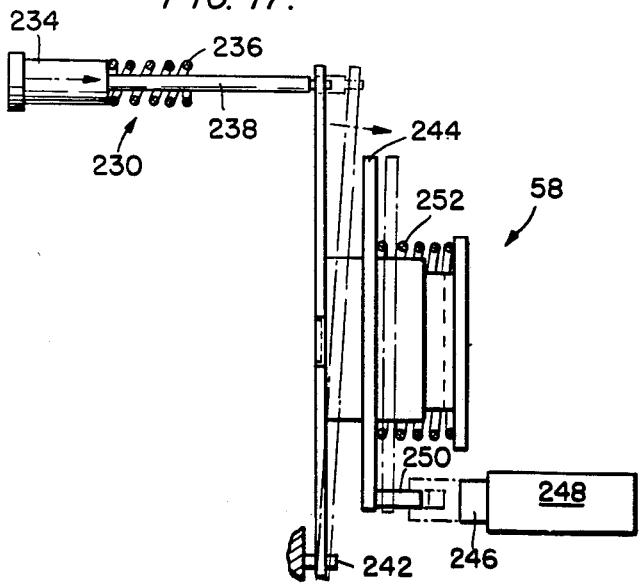
FIG. 17 is a side elevational view of the handwheel and trigger assembly of FIG. 16 illustrating the movement of the parts in phantom lines.

Manual elevation and trigger assembly 58 is best shown in FIGS. 14, 16 and 17. Referring thereto, it is seen that the handwheel and trigger assembly 58 performs two functions by manually elevating the main gun 38 and manually firing that gun. As the handle 230 is turned, the gears and gear box assembly 232 are turned thereby activating pump 233 which pressurizes hydraulic cylinder means 74. When the trigger button 234 attached to handle 230 is depressed, the gun fires. The operation of the firing mechanism is best illustrated in FIG. 17. Referring thereto it is seen that the trigger button 234 is depressed against spring 236 and plunger 238 extending through handle 230 pivots yoke 240 about yoke pivot point 242. Switch plate 244 is thereby driven forward causing the switch 246 of manual fire switch 248 to depress and activate the gun's firing mechanism (not shown). The switch 246 is shown to have a roller 250 attached to its end which rides on switch plate 244. This simplified operation provides that when the trigger button 234 is pressed, the gun 38 fires and when the button 234 is released the firing stops and the springs 236 and switch plate spring 252 return the components to their original position.

Figure 15:
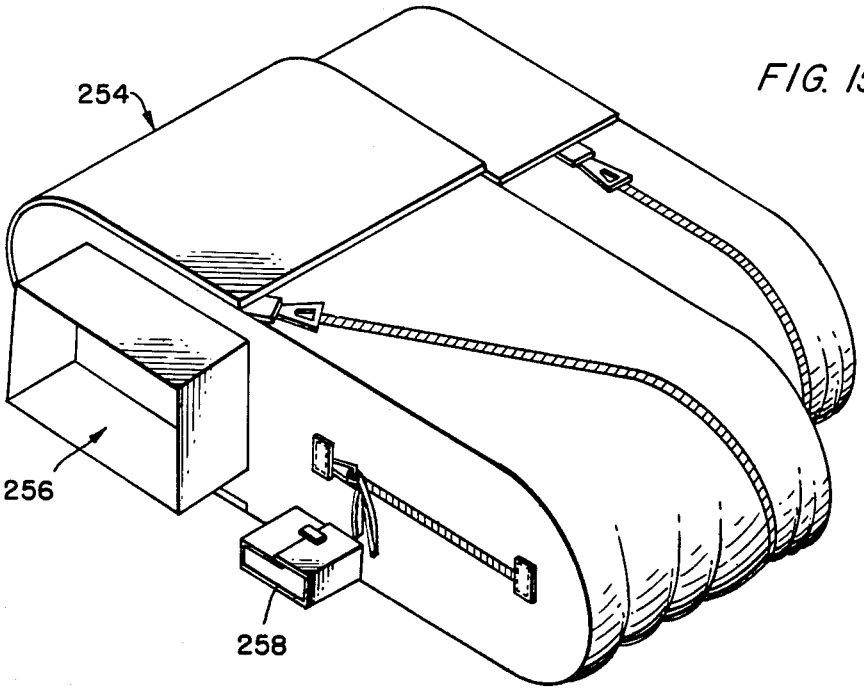
FIG. 15 is a perspective view illustrating in isolation the weapon propellant gas collection bag for the weapon system of FIG. 2.

Thus it is seen that the present invention for a novel weapon station provides for links 108 of stored high explosive ammunition or, alternatively, armor piercing ammunition to be smoothly fed from the novel storage box 44 to the main gun 38, the brass ejected out through the opening 168 of gun 38 and the spent links 108 fluidly ejected into a compartment 48 adjacent the gun 38 and then out to the exterior of the vehicle 30. The link fed ammunition for the machine gun 40 also feeds smoothly and without jamming from the machine gun storage box 52 to the machine gun 40 and then the spent links and brass are ejected out through the rotor end cap 82 into the compartment 48 and then to the exterior of the vehicle 30. Any propellant gases ejected from either the main gun 38 or the machine gun 40 are collected in the flexible boot 254 and which has an opening 256 for ammunition chutes 42 and an opening 258 for machine gun chute 50 as shown in FIG. 15, and ejected by the blower into the compartment and out to the exterior of the vehicle. The present turret assembly 32 can also be equipped with two four barrel grenade launchers shown at 262. The design of the interior of the basket assembly provides for two well designed stations for the commander and the gunner and the novel trigger mechanism for the gunner is conveniently located on his right side.

From the foregoing detailed description, it will be evident that there are a number of changes, adaptations and modifications of the present invention which come within the province of those skilled in the art. However, it is indented that all such variations not departing from the spirit of the invention be considered as within the scope thereof and as limited solely by the appended claims.

I claim:

1. A weapon system comprising:

a main gun having a firing mechanism mounted for rotation about a horizontal axis, a hydraulic cylinder means operatively connected at one end to said gun for rotating said gun in elevation about said horizontal axis, a pump operatively connected to said hydraulic cylinder means, a gear box assembly operatively connected to said pump, a handwheel assembly operatively connected to said gear box assembly, a handle connected to said handwheel assembly for rotating said handwheel assembly relative to said gear box assembly, a trigger attached to said handle, a switch having an actuating member and operatively connected to said firing mechanism, said switch being actuated by movement of said actuating member, a connecting means for connecting said trigger with said actuating member so that when said trigger is depressed said actuating member is moved thereby actuating said switch, said connecting means including a yoke connected at one end to said trigger and fixed at an opposite end to said rotatable handwheel assembly so that said one end moves relative to said handwheel assembly when said trigger is depressed, a switch plate engageable with said yoke and with said actuating member and positioned so that when said one end is moved by the depression of said trigger said switch plate moves said actuating member thereby actuating said switch, said handwheel assembly including a drive shaft rotated by the movement of said handle relative to said gear box assembly and operatively connected to said gear box assembly, said yoke and said switch plates having openings and said drive shaft passing through said openings, and a second spring means being disposed about said drive shaft for returning said switch plate to its original position after said trigger has been released.

2. The weapon system according to claim 1 including, said actuating member having a rolling member in constant rolling contact with said switch plate.

* * * * *